United States Patent [19]

Heronema

[11] 4,207,674

[45] Jun. 17, 1980

[54] WALL SCRAPING TOOL WITH BOWED BLADE

[76] Inventor: Joseph D. Heronema, 16309 Bellbrook, Covina, Calif. 91790

[21] Appl. No.: 883,715

[22] Filed: Mar. 6, 1978

[51] Int. Cl.[2] ..... B26B 3/00; A47L 13/02

[52] U.S. Cl. ..... 30/169; 15/236 R

[58] Field of Search ..... 15/104 S, 111, 235.4, 15/235.5, 235.8, 236 R, 245; 30/169, 170, 172, 356

[56] References Cited

U.S. PATENT DOCUMENTS

| | | | |
|---|---|---|---|
| 1,665,766 | 4/1928 | Binger | 30/172 |
| 1,790,466 | 1/1931 | Gordon | 15/143 R X |
| 2,756,499 | 7/1956 | Liesunaitis | 30/169 |
| 2,821,017 | 1/1958 | Liesunaitis | 30/169 |
| 2,912,851 | 11/1959 | Karnes | 15/235.5 |
| 3,363,316 | 1/1968 | Sharsten | 15/236 R X |
| 3,738,001 | 6/1973 | Roche | 30/171 |

*Primary Examiner*—Edward J. McCarthy
*Attorney, Agent, or Firm*—Boniard I. Brown

[57] ABSTRACT

A large tool for scraping flakes, debris, and droppings from drywall board panels installed in construction work, prior to painting. The blade may be about 1.5 m (5 ft.) long. The central handle is held in both hands. The blade is substantially flexible, and bowed or curved so that its end portions contact the wall first. When the blade is pressed against the wall, the resilient bowed blade straightens out so that the entire length of the blade is in close contact with the wall. The handle is provided with a T or cross-handle portion for pushing the blade along the wall surface by one hand and additionally an arched handle portion for the operator's other hand, to straighten out the curve of the bow. Because of its large size and close engagement with the wall, the scraper saves about half of the prior labor time.

11 Claims, 5 Drawing Figures

WALL SCRAPING TOOL WITH BOWED BLADE

BACKGROUND OF THE INVENTION

In building construction, drywall interior panels become spattered with debris such as "texture" coatings and stray particles of sprayed acoustic ceiling material. This debris must be removed before the drywall can be painted. Prior removal tools are hand scrapers with stiff blades about 0.6 m (2 ft.) long or less, or sanding poles which have pads of sandpaper on long handles. Since actual walls are not precisely flat, a prior stiff scraper blade will miss the low spots and must be passed repeatedly over the surface. Prior scrapers, hence, are limited in length, and work more slowly than is desirable.

SUMMARY OF THE INVENTION

The invention is a drywall scraping tool with a long, substantially flexible bowed blade and a dual handle of novel shape. The blade is preferably about 1.5 m (5 ft.) long. It is preferably of thin sheet steel secured into a moderately flexible backing strip.

A bowing strip is fastened along one side of the backing strip, and holds the backing and the blade in a slightly bowed or curved shape. The direction of the bow is with the ends of the blade down, i.e., toward the wall to be scraped. When the blade is first applied to the wall, its ends or tips will contact the wall first.

In use, the center of the blade is then pressed against the wall. This straightens out the bow or curve so that the whole length of the blade is in contact with the wall. The handle of the tool is attached to the center of the backing strip; hence pressing down on the handle straightens out the bow or curve of the blade.

The curvature typically amounts to 1–1.5 cm (about ½–¾ inch) at the middle of the blade.

The operator must push in two directions: along the direction of scraping; and against the wall. The tool, being large, is intended for two-handed use and has two handles. At the back end of the handle shaft, which may be about 0.4 m (15 in.) long, is a T-handle or cross-piece for pushing the blade along. Near the blade backing, a second handle is provided primarily for pushing the blade center against the wall to take out the bow. This second handle is offset upward from the shaft, and may be of a bail or loop shape.

DESCRIPTION OF THE PREFERRED EMBODIMENT

Figures 1, 2, 3, 4, 5:
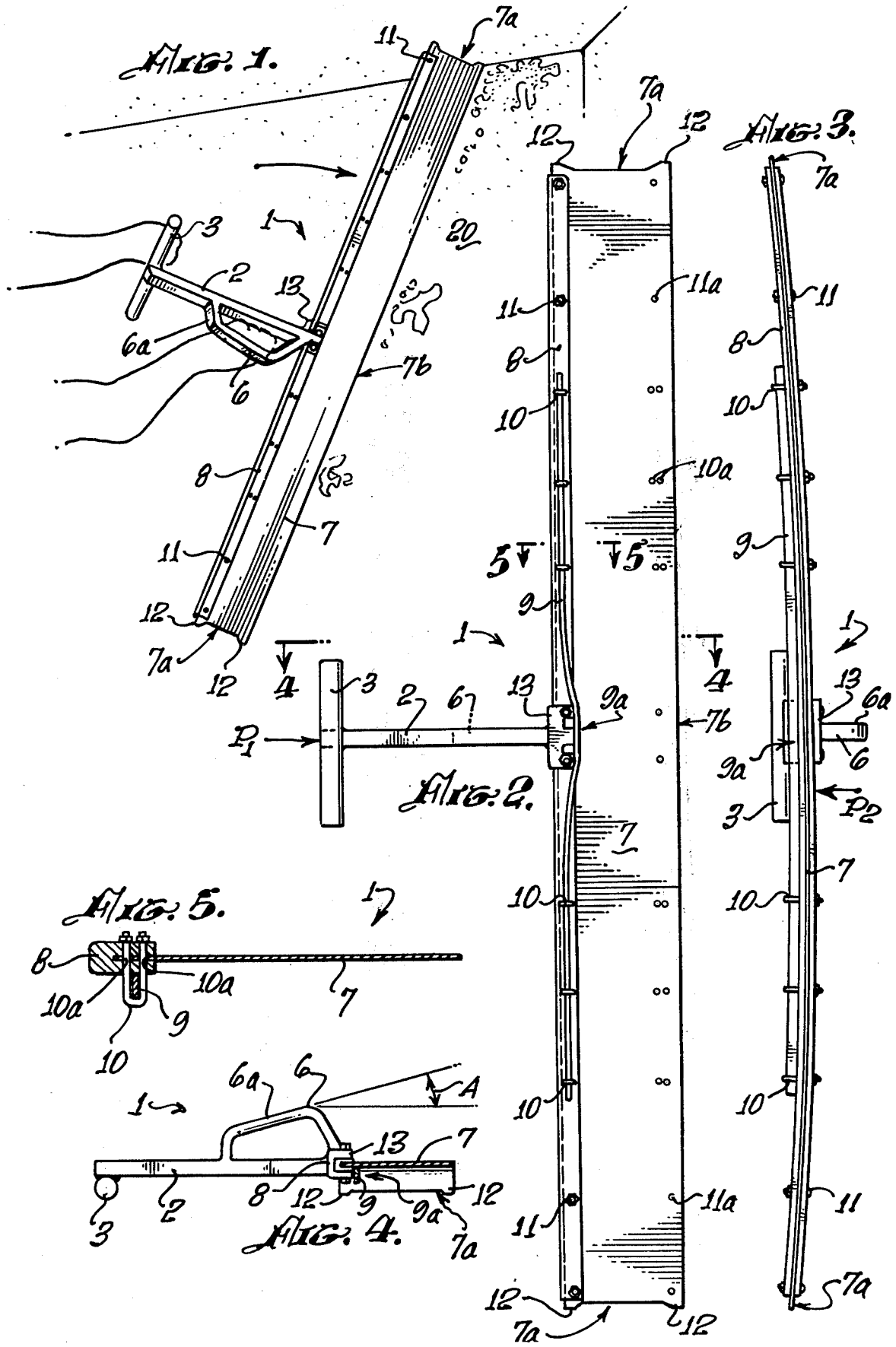
FIG. 1 is a perspective view of a scraper in use on a wall.
FIG. 2 is a bottom view of the scraper.
FIG. 3 is an end view.
FIG. 4 is a section on line 4—4 of FIG. 2.
FIG. 5 is a section on line 5—5 of FIG. 2.

In FIG. 1, the scraper indicated generally at 1, is held by the two handles 3 and 6. Blade 7 is scraping debris from wall 20. The operator's left hand exerts force $P_1$ on T-handle 3 to push the blade 7 along the wall. The right hand exerts force $P_2$ on arched handle 6 is a direction generally perpendicular to and against the wall, pushing the middle portion or center *7b* of blade 7 down to straighten out the bow or curvature. Referring to FIG. 4, the second handle has its grasping portion *6a* offset above the shaft 2, and preferably inclined at an angle A to fit the operator's hand.

The curvature or bowing is shown in FIGS. 3 and 4. In FIG. 3, the wall side of the scraper blade 7 is to the left. The blade end portions or tips *7a, 7a* touch the wall first. Pressure in direction $P_2$ on handle 6 then straightens out the bow in the blade to provide contact over its whole length.

FIG. 2 is a bottom view looking out from the direction of the wall. T-handle 3 is at the back end of handle shaft 2. Shaft 2 is attached to the blade backing strip 8 by any suitable means at 13. In FIG. 2 the arched or bail handle 6 is not visible because it is on the upper side; it is visible in FIGS. 1, 3, and 4.

The bowing strip is shown at 9 in FIGS. 2, 3, and 5. It is a suitable strip of metal disposed along the underside of the blade backing strip 8. Its center portion *9a*, FIG. 2, is bent to avoid the handle shaft connection 13. This bowing strip 9 extends symmetrically along about two-thirds of the length of blade 7, and is secured at intervals to the backing strip 8 by suitable fasteners such as U-bolts 10, FIGS. 2, 3, and 5. See particularly FIG. 5.

In assembling the tool, the blade 7 may be held in the desired curved shape while the U-bolts 10 are loose, and the bolts then tightened. The blade 7 is thus biased to the desired curvature by tension in bowing strip 9.

The blade 7 may preferably be of flexible sheet steel about 0.5 mm (0.02 inches) thick and 15 cm (5 inches) wide. It may be secured into a slot running along the backing strips 8 by suitable screws 11 through holes *11a*, FIG. 2. The blade 7 is preferably made reversible for additional wear life, so having rows of holes *11a* for screws 11 and holes *10a* for the U-bolts 10 along both edges. To facilitate getting into corners of a room, the end portions of blade 7 are preferably undercut to provide "ears" at its corners as shown at 12, FIGS. 1, 2, and 4.

In the claims, "down" means toward the wall, and "back" means toward the T-handle 3 along the direction of shaft 2.

Shaft 2 preferably lies about in the plane of the blade 7.

The inventor claims:

1. A wall scraping tool comprising:

an elongated, substantially flexible flat blade having a middle portion and tip end portions;

bias means mounted on the blade to bias said blade to a normally bowed shape with its tip ends down to first contact a wall surface when the tool blade is applied thereto;

handle means extending from the back middle portion of the blade, said handle means being adapted to be grasped by one hand of an operator to push the tool along the surface of the wall, and adapted to be grasped by the other hand of said operator to exert downward force on said middle portion of said blade to straighten out said bowed blade shape to produce even contact of said blade along its length against said wall surface while being pushed along the wall surface.

2. A wall scraping tool comprising:

an elongated, substantially flexible flat blade having a middle portion and tip end portions;

a backing strip fastened along the back edge of said blade, said shaft being attached to said backing strip;

bias means to bias said blade to a normally bowed shape with its ends down;

said bias means comprising a bowing strip extending along the lower side of said backing strip and fastened thereto in tension;

a handle shaft extending back from about the middle portion of said blade at about right angles thereto and about in the plane thereof;

a first handle on said shaft adapted to be grasped by one hand of an operator to push in the direction of said shaft; and a second handle extending from said shaft forward of said first handle and having a grasping portion offset above said shaft and adapted to be grasped by the other hand of said operator to exert downward force on said middle portion of said blade to straighten out said bowed blade shape to produce even contact of said blade along its length against said wall while being pushed therealong.

3. A tool as in claim 2, wherein:

said first handle is a substantially straight member fastened across the back end portion of said shaft and about perpendicularly thereto.

4. A tool as in claim 3, wherein:

said second handle is a loop-like member extending from about the center of said backing strip to a point rearward thereof on said shaft.

5. A tool as in claim 4, wherein:

said grasping portion is substantially straight and inclined at an angle between about 10 and 30 degrees with respect to said shaft.

6. A wall scraping tool according to claim 1, wherein:

the handle means comprises a first handle extending from about the middle portion of the blade for grasping by said one hand of an operator to push the tool along the wall surface, and a second handle connected with the blade and with the first handle and having a portion for grasping by the other hand of the operator to exert downward force on the blade.

7. A wall scraping tool according to claim 1 or claim 6, wherein:

said bias means comprises a biasing strip secured in tension along the back edge of the blade.

8. A wall scraping tool according to claim 1 or claim 6, and further including:

a backing strip along the back edge of the blade on which said biasing strip and the handle means are mounted.

9. A wall scraping tool according to claim 6, wherein:

said first handle means includes a member extending transversely of a shaft extending from the back middle portion of the blade.

10. A wall scraping tool according to claim 6 or claim 9, wherein:

the second handle means comprises an open bail handle connected with the first handle means.

11. A wall scraping tool according to claim 1 or claim 2 or claim 6, and further including:

ear portions defined on the tip end portions of the blade to facilitate scraping portions of said wall adjacent to intersecting surfaces.

* * * * *